United States Patent [19]

Gange

[11] 4,012,253

[45] Mar. 15, 1977

[54] HOLOGRAPHIC RECORDING MEDIUM

[75] Inventor: Robert Allen Gange, Belle Mead, N.J.

[73] Assignee: RCA Corporation, New York, N.Y.

[22] Filed: Oct. 16, 1974

[21] Appl. No.: 515,369

Related U.S. Application Data

[62] Division of Ser. No. 309,754, Nov. 27, 1972, abandoned.

[52] U.S. Cl. ..... 96/1.5; 96/27 H; 96/1.1

[51] Int. Cl.[2] ..... G03G 5/00; G03G 5/10; G03C 5/04

[58] Field of Search ..... 96/1.1, 1.5, 1 PS, 1 M, 96/27 H; 346/74 TP, 77 E; 350/3.5; 178/6.61 P

[56] References Cited

UNITED STATES PATENTS

| | | | |
|---|---|---|---|
| 3,243,293 | 3/1966 | Stockdale | 96/1.5 |
| 3,266,045 | 8/1966 | Schattery | 96/1.1 |
| 3,565,612 | 2/1971 | Clark | 96/1 M |
| 3,598,581 | 8/1971 | Reinis | 96/1 M |
| 3,640,708 | 2/1972 | Humphriss et al. | 96/1.5 |
| 3,723,112 | 3/1973 | Luebbe | 96/1 M |
| 3,741,759 | 6/1973 | Cicarelli et al. | 96/1.1 |

*Primary Examiner*—David Klein
*Assistant Examiner*—John L. Goodrow
*Attorney, Agent, or Firm*—G. H. Bruestle; B. E. Morris; J. T. Harcarik

[57] ABSTRACT

A holographic recording medium comprising a conductive substrate, a photoconductive layer and an electrically alterable layer of a linear, low molecular weight hydrocarbon polymer has improved fatigue resistance. An acrylic barrier layer can be interposed between the photoconductive and electrically alterable layers.

3 Claims, 2 Drawing Figures

HOLOGRAPHIC RECORDING MEDIUM

The invention described herein was made in the performance of work under a NASA contract and is subject to the provision of Section 305 of the National Aeronautics and Space Act of 1958, Public Law 85-568 (72 Stat. 435; 42 U.S.C. 2457).

This is a division of application Ser. No. 309,754, filed Nov. 27, 1972, now abandoned.

BACKGROUND OF THE INVENTION

This invention relates to an improved electrically alterable recording medium. More particularly, this invention relates to an electrically alterable holographic recording medium which does not fatigue after numerous write-erase cycles.

Phase holograms can be formed on a heat softened thermoplastic surface which selectively deforms during exposure to an applied charge pattern, as has been disclosed by Urbach in U.S. Pat. No. 3,560,205. According to this system, a corona discharge device connected to a suitable recording medium ionizes the air near the surface of the thermoplastic whereupon positive ions are deposited uniformly on the surface of the thermoplastic. This surface is now exposed to an image by means of coherent light split into an object beam and reference beam in known manner. The light interacts with a photoconductor which causes a redistribution of the charge in the areas where it impinges on the thermoplastic. When the thermoplastic is charged again, the electric field increases in the previously illuminated areas. The thermoplastic is then exposed to a temperature sufficient to soften its surface which deforms according to the electric field, becoming thinner or forming valleys in the areas of high field intensity. When cooled to room temperature, a hologram is recorded as a thickness variation or pattern in the thermoplastic. Such holograms can be erased in the absence of exposure and corona discharge by heating the thermoplastic above its softening point to a temperature sufficient to allow the surface tension of the thermoplastic to revert to its undeformed state.

This holography system would be highly useful in optical memory devices due to its ability to write and erase a series of holograms in situ. However, the thermoplastics employed heretofore gradually degrade or show fatigue after repeated write-erase cycles, when sharp, clear holograms can no longer be formed. In some cases, fatigue is discernible after several write-erase cycles.

Electrically alterable recording media described as suitable for recording deformation holograms comprise conductive substrates, a photoconductive insulating layer over the substrate and a deformable insulating thermoplastic layer over the photoconductor. The thermoplastics suggested heretofore for this system include natural resins, such as glycerol and pentaerythritol esters of partially hydrogenated rosin, and synthetic polymers such as p-alpha-methylstyrene, terpolymers of styrene, indene and isoprene, polyterpene resins from $\beta$-pinene, olefin-diene resins, styrene-butadiene resins, polystyrene, coumaroneindene resins, chlorinated polyphenyl resins, styrene-acrylate copolymers, vinyltolueneacrylate copolymers, alkyd resins, mixtures of styrene and silicone resins and unreactive phenol-formaldehyde resins.

These materials show fatigue after repeated write-erase storage cycles; in many cases the onset of fatigue is noted after a few hundred cycles. In order to be able to be incorporated into a practical optical memory system, the recording medium must be immune to fatigue over numerous write-erase cycles. Thus the search for an improved electrically alterable or deformable recording medium for holographic storage has continued.

SUMMARY OF THE INVENTION

I have discovered that linear, low molecular weight hydrocarbon polymers can be employed as the electrically alterable layer of a holographic recording medium. The resultant recording medium can withstand many write-erase cycles with no discernible change in its physical or chemical properties nor molecular structure, and it can continue to form and erase sharp, clear holograms.

DETAILED DESCRIPTION OF THE INVENTION

Figure 1:
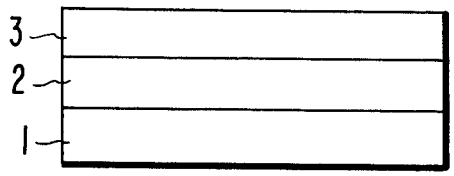
FIG. 1 is a cross-sectional view of one embodiment of a recording medium of the invention and FIG. 2 is a cross-sectional view of another embodiment of a recording medium of the invention.

The present holographic recording medium comprises a conductive substrate, a photoconductive insulating layer on the substrate and a linear low molecular weight hydrocarbon polymer as the electrically alterable layer on the insulating layer.

The conductive substrate is conventional, and can be flexible or rigid. It can be made of a conductive metal, such as aluminum, brass, copper and the like; or of a non-conductive substrate coated with a thin conductive layer. Suitable non-conductive substrates include glass, quartz, polymers and the like, which can be coated with a conductor such as tin oxide, copper iodide, indium oxide and the like. Preferably, the substrate is transparent. Such substrates are well known, and include glass coated with a thin, transparent tin oxide or indium oxide film, or like coated polymeric films of polyethylene terephthalate, polycarbonates, polyurethanes, acrylics and the like.

The insulating photoconductor is also conventional and can be inorganic, such as a layer of amorphous seleneium, or pigments such as cadmium sulfide, cadmium selenide, zinc sulfide, zinc selenide, zinc oxide, lead oxide, lead sulfide, mercuric sulfide, antimony sulfide, mercuric oxide, indium trisulfide, titanium dioxide, arsenic sulfide, gallium selenide, lead iodide, lead selenide, lead telluride, gallium telluride, mercuric selenide, and the like. Alternatively, the photoconductor can be organic, such as anthracene-3-benzylideneaminocarbazole, poly-N-vinylcarbazole, 2,5-bis(p-aminophenyl-1)-1,3,4-oxadiazole, 1,4-dicyanoaphthalene, 2,4-diphenylquinazolin, 1-methyl-2-(3',4'-dihydroxymethylenephenol)benzimidazole and the like. These and other organic photoconductors can be complexed with Lewis acids, such as 2,4,7-trinitrofluorenone, as is known. High sensitivity photoconductors such as poly-N-vinylcarbazole containing 2,4,7-trinitrofluorenone are preferred.

Nonfatiguable linear hydrocarbons useful as the electrically alterable layer have low molecular weights, i.e., about 300 to about 2000, which preferably are solid at room temperature but which have low softening points. Suitable materials include microcrystalline natural waxes or low molecular weight, linear polymers of ethylene.

These hydrocarbons are straight chains of $—CH_2—$ units, substantially without branched chains, unsaturation, or active end groups. They are further characterized by a narrow molecular weight distribution, that is, most of the molecules of the resin have similar chain lengths. Suitable commercial products include Boreco Polywax, a linear polyethylene available in molecular weights in the range about 1000 to about 2000 and "Be Square" 190/195 Amber or No. 1 white microcrystalline waxes having about 60 carbon atoms per molecule, available from the Boreco Division of Petrolite Corporation. These materials have melting points between about 40° C. and about 125° C.

Although the reason for the efficacy of the present materials is not completely understood, it is believed the straight chain configuration is responsible for the long life of the recording medium described herein, since little cross-linking or reaction between end groups of these straight chain molecules occurs in the presence of high electric fields throughout numerous cycles of softening and hardening or heating and cooling.

The electrically alterable layer can be applied in any convenient manner, but is preferably applied from solution, as by brushing, dip coating, spraying and the like. Electrostatic deposition can also be employed. The electrically alterable layer must be thick enough so that well defined hills and valleys may be formed in it upon exposure, but the exact thickness is not critical and can be up to 5 microns or more. Thicker layers have deeper peaks and valleys in the holographic pattern and thus may give a clearer, better defined hologram; but the available holographic density, i.e., the number of bits that can be stored in a given hologram area, will be decreased due to reduced spatial bandwidth. The optimum thickness for a given application can be readily determined by a series of test runs. Preferably, the thickness of the electrically alterable layer will be from about 0.3 to about 0.7 microns thick.

Referring now to the drawings, in FIG. 1 there is shown a cross-sectional view of a recording medium of the invention. The recording medium comprises a conductive layer 1 having a photoconductive layer 2 thereon and an electrically deformable layer 3 over the layer 2.

Figure 2:
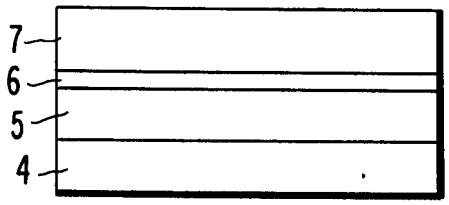

FIG. 2 is a cross-sectional view of another embodiment of a recording medium. This recording medium has a conductive layer 4, a photoconductive layer 5 thereon, a thin barrier layer 6 on the layer 5 and an electrically deformable layer 7 over the barrier layer 6.

Holograms can be written and erased in the abovedescribed recording medium many times without sign of fatigue. Holograms can be written using a pulsed heat source, such as pulsed ohmic heating via the transparent conductor layer, or, preferably, exposed to a constant thermal bias using a suitable constant direct current and current pulses which produce a controlled heat gradient over short time intervals. This thermal bias can be above room temperature, suitably just below the softening point of the linear hydrocarbon employed, which minimizes and controls the temperature excursions on pulsing, and results in further improvement in the life of the recording medium.

In the event that the thermoplastic is exposed to sustained elevated temperatures for long periods of time, such as when using direct current as the bias heat source, reaction between the thermoplastic and the photoconductor may be encountered. In that case it may be desirable to apply a barrier layer between the photoconductor layer and the recording layer. A thin layer of highly polar, transparent material such as an acrylic resin commericially available as Elvacite 2013 resin from du Pont de Nemours and Company can be employed for this purpose. This resin is a low molecular weight methyl/n-butylmethacrylate copolymer having an inherent viscosity of 0.2, determined from a solution containing 0.25 gram of polymer in 50 ml of chloroform at 25° C.

A defect-free, thin film of the barrier polymer can be applied by dipping the layer to be coated into a solution of the acrylic resin or by spin coating in known manner. The thickness of the barrier layer, although not critical, should be regulated so that an excessive amount of the applied electric field will not be lost across this layer. Suitably the barrier layer can be up to about 0.25 micron in thickness.

The invention will be further illustrated by the following examples, but it is to be understood that the invention is not meant to be limited to the details described therein. In the examples, parts and percentages are by weight unless otherwise noted.

EXAMPLE 1

A glass substrate coated with a thin, transparent indium oxide layer was dipped into a solution of poly-N-vinylcarbazole: trinitrofluorenenone (10:1) in 1:1 p-dioxane-methylene chloride so as to apply a layer about 1–2 microns thick. Another solution of 0.35 parts of Amber wax, a microcrystalline hydrocarbon wax having about 60 carbon atoms per molecule in straight chains, available from Bareco Company and having a melting point of 88° C., softening point (Ring and ball) of 42° C., and a Saybolt viscosity at 99° C. of 75 in 40 parts by volume of n-hexane was prepared at about 60°–65° C. The coated substrate was immersed in the solution and withdrawn at a rate of 2 inches per second so as to deposit a layer about 0.6 micron thick when the solvent was evaporated.

Holograms were formed in the recording medium prepared as above with a helium-neon laser using a continuous corona discharge, writing with heat pulses of 2–5 milliseconds in duration and erasing by applying heat above the softening point of the wax in the absence of light, using heat pulses of similar duration. After 7000 write-erase cycles, the recording medium showed no sign of fatigue.

EXAMPLE 2

The procedure of Example 1 was followed except that a barrier layer was applied onto the photoconductive layer as follows. First, 0.3 part of an acrylic resin (available commercially as Elvacite 2013 from duPont de Nemours and Company) was dissolved in 40 parts by volume of acetone at room temperature. The acrylic resin solution was spun onto the photoconductive layer at about 1000 rpm. After evaporating the solvent, a barrier layer about 1000 A thick had been deposited.

EXAMPLE 3

The procedure of Example 1 is followed except that a barrier layer is applied onto the photoconductive layer as follows. A solution containing 0.2 part of Elvacite 2013 in 5 parts by volume of acetone warmed to 60° C. is prepared to which is added dropwise 50 parts by volume of ethanol also warmed to about 60° C. A glass plate having a photoconductive layer as in Example 1 is immersed in the above solution and withdrawn at a rate of 2 inches per second. A uniform barrier film about 1000 A thick is deposited onto the photoconductive layer.

I claim:

1. A medium for recording and erasing phase holograms in the form of a surface relief pattern consisting essentially of in sequence an electrically conductive substrate, a photoconductive insulating layer, a transparent, polar, barrier layer, and an electrically alterable storage layer consisting essentially of a linear, microcrystalline hydrocarbon polymer having a molecular weight in the range from about 300 to about 2000.

2. A medium according to claim 1 wherein the barrier layer is a layer of an acrylic resin up to about 0.25 micron in thickness.

3. A medium according to claim 1 wherein the barrier layer is a layer of a methyl/n-butyl-methacrylate copolymer having an inherent viscosity of 0.2 and the barrier layer is up to about 0.25 micron in thickness.

* * * * *